US008130119B2

(12) United States Patent
Mase

(10) Patent No.: US 8,130,119 B2
(45) Date of Patent: Mar. 6, 2012

(54) APPARATUS AND PROGRAM FOR CONTROLLING TRAFFIC SIGNAL IN ROAD CONSTRUCTION SECTION

(75) Inventor: Kenji Mase, Chita-gun (JP)

(73) Assignee: Denso Corporation, Kariya (JP)

( * ) Notice: Subject to any disclaimer, the term of this patent is extended or adjusted under 35 U.S.C. 154(b) by 308 days.

(21) Appl. No.: 12/385,422

(22) Filed: Apr. 7, 2009

(65) Prior Publication Data

US 2009/0256722 A1 Oct. 15, 2009

(30) Foreign Application Priority Data

Apr. 9, 2008 (JP) ..... 2008-101665

(51) Int. Cl.
*G08G 1/095* (2006.01)

(52) U.S. Cl. ..... 340/907

(58) Field of Classification Search ..... 340/907, 340/905, 934, 990, 988, 995.13; 701/210
See application file for complete search history.

(56) References Cited

U.S. PATENT DOCUMENTS

| | | | | |
|---|---|---|---|---|
| 5,182,555 | A * | 1/1993 | Sumner | 340/905 |
| 5,293,163 | A * | 3/1994 | Kakihara et al. | 340/995.13 |
| 5,428,545 | A * | 6/1995 | Maegawa et al. | 701/210 |
| 7,493,208 | B1 * | 2/2009 | Craine | 701/117 |
| 2005/0071081 | A1 * | 3/2005 | Hirose et al. | 701/210 |
| 2005/0090974 | A1 * | 4/2005 | Hirose | 701/208 |
| 2005/0096839 | A1 * | 5/2005 | Nakano et al. | 701/200 |
| 2006/0095195 | A1 * | 5/2006 | Nishimura et al. | 701/96 |
| 2006/0167626 | A1 * | 7/2006 | Hashizume | 701/210 |

FOREIGN PATENT DOCUMENTS

| | | |
|---|---|---|
| JP | A-10-124794 | 5/1998 |
| JP | A-10-307983 | 11/1998 |
| JP | A-2001-291188 | 10/2001 |
| JP | A-2002-49985 | 2/2002 |
| JP | A-2004-287983 | 10/2004 |
| JP | A-2006-343814 | 12/2006 |

OTHER PUBLICATIONS

Office Action dated Nov. 17, 2009 from Japan Patent Office in corresponding JP application No. 2008-101665 (and English translation).

Office Action dated Mar. 1, 2010 from Japan Patent Office in corresponding JP application No. 2008-101665 (and English translation).

* cited by examiner

*Primary Examiner* — Phung Nguyen
(74) *Attorney, Agent, or Firm* — Posz Law Group, PLC

(57) ABSTRACT

A traffic signal control apparatus acquires position information and travel condition information from vehicles around a construction section of a road in wireless communication, and determines a traffic congestion condition at the positions of those vehicles based on the acquired information. The traffic signal control apparatus then controls traffic signals set up on ends of the construction section in a manner that eases the traffic congestion condition around the construction section based on the determination result of the traffic congestion condition.

9 Claims, 2 Drawing Sheets

APPARATUS AND PROGRAM FOR CONTROLLING TRAFFIC SIGNAL IN ROAD CONSTRUCTION SECTION

CROSS REFERENCE TO RELATED APPLICATION

The present application is based on and claims the benefit of priority of Japanese Patent Application No. 2008-101665, filed on Apr. 9, 2008, the disclosure of which is incorporated herein by reference.

FIELD OF THE DISCLOSURE

The present disclosure generally relates to a traffic signal control apparatus and a program for controlling the apparatus.

BACKGROUND INFORMATION

Conventionally, an automated apparatus or an unmanned apparatus for detecting a condition of traffic congestion due to a road construction is proposed. That Is, for example, Japanese patent document JP-A-2002-49985 discloses a technique that determines a congestion time based on a travel time of a specific vehicle between two positions in the proximity of a construction section of a road in addition to the number of vehicles passing a certain point.

However, the above technique does not necessarily provide an accurate detection result because the congestion condition is estimated based on vehicle information that is derived only from a limited number of positions.

SUMMARY OF THE DISCLOSURE

In view of the above and other problems, the present disclosure provides a technique for accurately detecting a traffic congestion condition due to a construction work on a road.

In an aspect of the present disclosure, a traffic signal control apparatus that controls traffic signals disposed on both ends of a construction section includes: a vehicle information acquisition unit for acquiring, from a vehicle in a proximity of the construction section, information regarding a vehicle position and a travel condition of the vehicle through wireless communication; a determination unit for determining a congestion condition at the position indicated in the information regarding the vehicle position that is acquired by the vehicle information acquisition unit based on the information regarding the travel condition of the vehicle that is acquired by the vehicle information acquisition unit; and a control unit for controlling a signaling condition of the traffic signals based on a determination result of the determination unit so as to ease a traffic congestion around the construction section.

The traffic signal control apparatus can thus acquire information on the congestion condition of a position of the vehicle based on received information regarding the vehicle position and the travel condition from the vehicle. Therefore, the traffic signal control apparatus can determine the position of the vehicle in association with the relevant travel condition, by utilizing the information regarding the vehicle position (e.g., longitude, latitude, and a distance toward the construction section along the road) in addition to the information of the travel condition of the vehicle, when the information of the travel condition is received from the vehicle that is traveling not only a specific position but also any position of the road. That is, in other words, an information acquisition position for acquiring the information of the vehicle can be diversified, thereby leading to a more-accurate detection and recognition of the traffic congestion condition.

Further, the traffic signal control apparatus controls the traffic signals in a manner that eases the traffic congestion around the construction section based on the detection result of the traffic congestion, thereby contributing to easing of the traffic congestion due to the construction work.

Further, the traffic signal control apparatus of the present disclosure can also be described and recited as a program product for realizing the same operation scheme and achieving the same advantageous effects.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
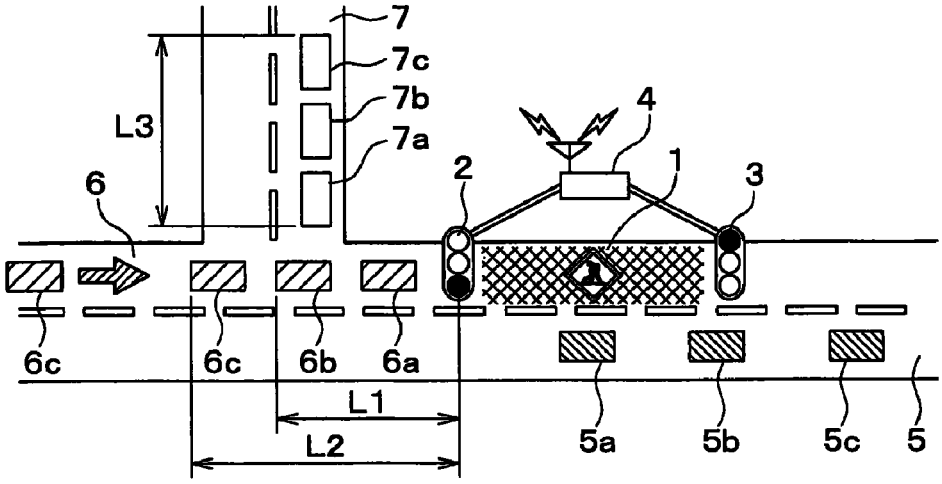
FIG. 1 is an illustration of a traffic congestion easing system in an embodiment of the present disclosure.

An embodiment of the present disclosure is hereinafter described. FIG. 1 is an illustration of a traffic congestion easing system in an embodiment of the present disclosure. In this example, traffic signals 2, 3 are respectively set up at each of the section ends of a construction section 1 (indicated by a road work sign used in Japan) in a temporal manner. The traffic signals 2, 3 are arranged for facilitating a smooth traffic in the construction section 1 where an alternative one way traffic is implemented.

In a situation of FIG. 1, vehicles 5*a* to 5*c* are passing the construction section 1 in a lane 5 according to the traffic signal 3 that is displaying a traffic allowance signal. In this case, the illustration shows the situation in a left-side traffic system implemented in, for example, Japan. Further, vehicles 6*a* and 6*b* are stopping in a lane 6 before the construction section 1 according to the traffic signal 2 that is displaying a traffic prohibition signal. At this point in this situation, a congestion length in the lane 6 is represented as a length L1. Then, the congestion length increases to a length L2 when a vehicle 6*c* catches up to the vehicle 6*b* to stop there. Further, in a lane 7 that leads to the construction section after turning to the left, there are vehicles 7*a* to 7*c* stopping. In total, the congestion length that leads to the construction section 1 from the signal 2 is L1+L3.

Then, as the equipment which controls these signals 2, 3, a traffic signal control apparatus 4 is arranged. The traffic signal control apparatus 4 wirelessly communicates with at least one of the vehicles 5*a* to 5*c*, 6*a* to 6*c*, 7*a* to 7*c* in the lanes 5, 6, 7 around the construction section 1. The apparatus 4 receives, through the wireless communication, vehicle information from those vehicles, and determine a congestion condition based on the received information. The apparatus 4 then controls, based on the determined congestion condition, display contents of the traffic signals 2, 3 so that the traffic congestion is eased In the following, the configuration and the operation of such a traffic congestion easing system are described. The traffic congestion easing system includes the traffic signals 2, 3, the traffic signal control apparatus 4, and vehicle communication systems respectively disposed in vehicles for communication with the traffic signal control apparatus 4.

Figure 2:
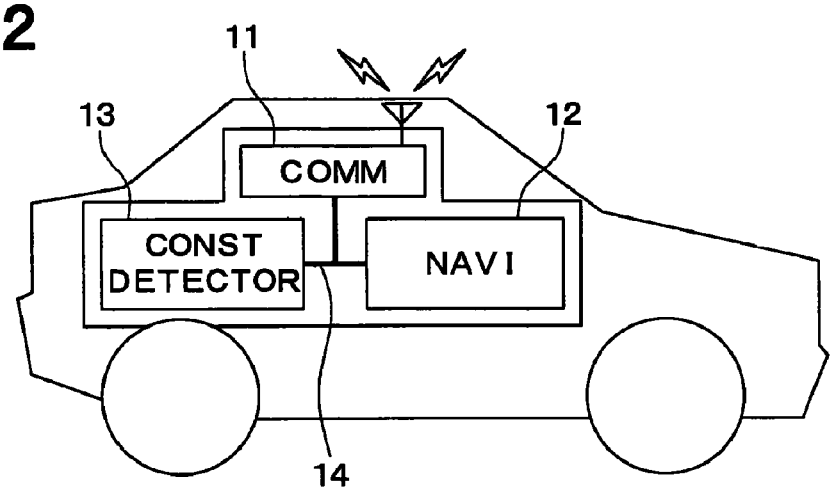
FIG. 2 is a block diagram of a vehicle communication system that is disposed in a vehicle.
Figure 3:
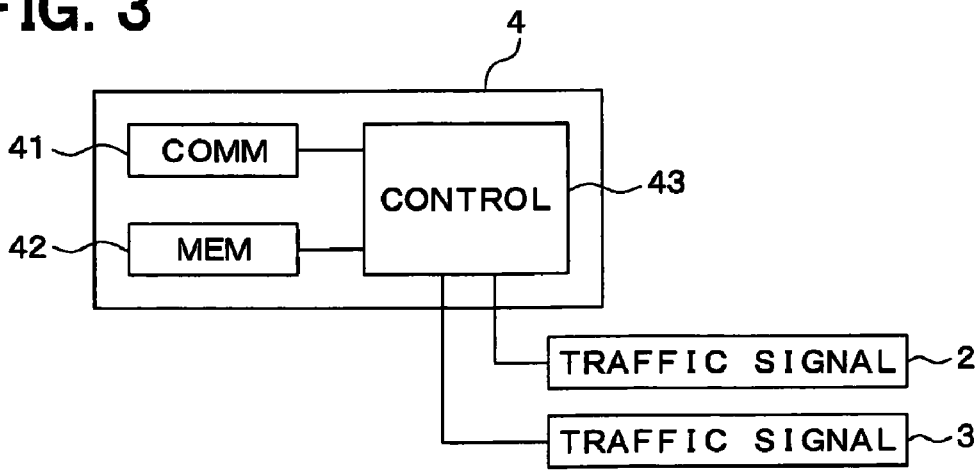
FIG. 3 is a block diagram of a traffic signal control apparatus.

The configuration of the vehicle communication system which is disposed in each vehicle is shown in FIG. 2. As shown in the figure, the vehicle communication-system has a communication unit 11, a navigation apparatus 12 and a construction detector 13. These devices 11 to 13 are capable of communicating with each other through an in-vehicle LAN 14 in terms of signal exchange.

The communication unit 11 receives wireless signal from the traffic signal control apparatus 4, and then transmits data in the received signal to the construction detector 13. Further, the communication unit 11 transmits wireless signal to the traffic signal control apparatus 4 under control of the construction detector 13.

The navigation apparatus 12 is equipped with a GPS receiver, a speed sensor, an acceleration sensor, a yaw rate sensor together with other sensors, and, based on information from these equipments, detects and determines the present location (i.e., the latitude, the longitude) of the vehicle, vehicle speed, a direction of the travel and so on.

Further, the navigation apparatus 12 is equipped with map data. The map data includes road data and facility data. The road data includes the ID of the link, the position information of the link, classification information of the link (e.g., whether a road is a priority road or not (i.e., a major road or the like), a school road or not), the ID of the node, the position information of the node, classification information of the node, the speed limit information of the node and connection information regarding the relation between the node and the link, and so on. The facility data includes multiple records in each of the facility types such as the department store, the park, the pier, the railway crossing, the traffic signal. In each of those records, data regarding the respective facilities such as name information, location information, street address information, facility type information and the like. Further, the map data includes position information of high-accident locations.

When the navigation apparatus 12 receives a user input for specifying a destination, it calculates an optimum guide route from the present location of the vehicle to the destination based on the map data, and assists the travel of the vehicle along the calculated route by using right/left turn voice guidance, map images and the like.

Further, when the navigation apparatus 12 receives a request for information from the construction detector 13, the apparatus 12 transmits the requested information to the construction detector 13.

The construction detector 13 is composed of a microcomputer having a CPU, a ROM, an I/O, and the like. The CPU executes a program that is retrieved from the ROM, and the CPU reads information stored in the RAM and ROM in the course of program execution. Further, the CPU writes information to the RAM and exchanges signals with the communication unit 11 and the navigation apparatus 12 in the course of program execution. The operation of the traffic signal control apparatus 4 is described later.

The traffic signal control apparatus 4 has a communicator 41, a memory 42 and a controller 43. The communicator 41 is a device for wireless communication with the vehicles 5*a* to 5*c*, 6*a* to 6*c*, 7*a* to 7*c* around the communicator 41.

The memory 42 is a writable, non-volatile memory medium for storing the map information, for example, mentioned above.

The controller 43 is composed of a microcomputer or the like having a CPU, a ROM, an I/O, and the like. The CPU executes a program that is retrieved from the ROM, and the CPU reads information stored in the RAM, ROM, and the memory 42 in the course of program execution. Further, the CPU writes information to the RAM and the memory 42, and exchanges signals with the communicator 41 and the controller 43 for controlling the traffic signals 2, 3.

The operation of the traffic congestion easing system mentioned above is described in the following. The controller 43 of the traffic signal control apparatus 4 controls the communicator 41, and regularly transmits the position information of the construction section 1 to the vehicle around the apparatus 4 (by an interval of, for example, 1 second). The position information to be transmitted may include the link ID of the link where the construction section 1 is included, and information regarding a road section that covers the construction section 1 in the link. The position information to be transmitted may be input by an operator of the traffic signal control apparatus 4 by using an input device (not shown), and the inputted information may be stored in the memory 42 by the controller 43.

Figure 4:
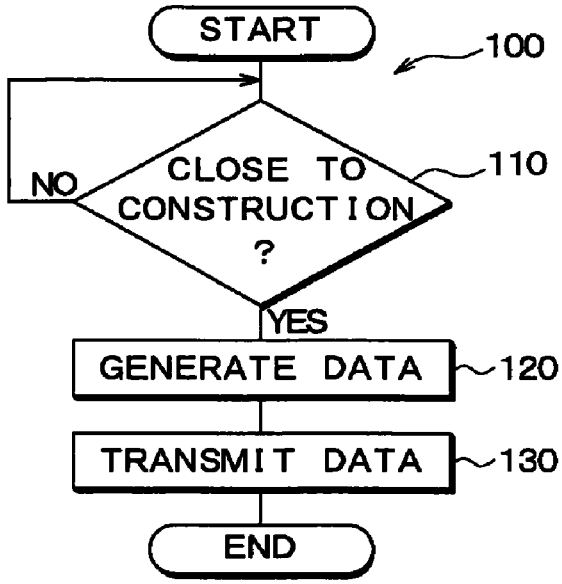
FIG. 4 is a flow chart of a process that is performed in a construction detector.

Further, the construction detector 13 in each vehicle repeatedly executes a program 100 shown as a flow chart in FIG. 4. In the course of execution of the program 100, the process waits until the vehicle enters the proximity of the construction section 1 in S110, and then generates data to be transmitted in S120 after determining that the vehicle is in the proximity of the construction section 1. Then, the process transmits the data regarding the vehicle in S130 by the communication unit 11. In the following description, in front of step numbers of flow charts in FIGS. 4 & 5, a capital letter 'S' (i.e., in upper case) is supplemented as already been supplemented in the present paragraph.

Whether the vehicle has entered in the proximity of the construction section 1 is determined by using the following criterion. That is, for example, when the present location of the vehicle is at a reference distance of 500 meters from the construction section 1, the vehicle is determined to be in the proximity. The construction detector 13 receives the information on the position of the construction section 1 by the communication unit 11, and determines the position of the construction section 1 based on the received information. Further, the construction detector 13 acquires the present location of the vehicle by requesting the information for the navigation apparatus 12.

The vehicle data generated in S120 includes a vehicle ID, a current time, a current speed of the vehicle (i.e., an example of travel condition information), a current approach direction of the vehicle to the construction section 1 (i.e., another example of travel condition information), a current distance of the vehicle to the construction section 1 along the road (i.e., an example of position information), and the present location of the vehicle (i.e., another example of position information). If the vehicle is currently stopping, a time of stopping (i.e., an example of travel condition information) is also included in the vehicle data.

The approach direction to the construction section 1 indicates one of three directions, that is, (a) a direction straight to the construction section 1, (b) a direction to the construction section 1 after turning to the left, or (c) a direction to the construction section 1 after turning to the right. That is, for example, in FIG. 1, the approach direction of the vehicles 5*a* to 5*c* is straight to a traffic signal 3 side, the approach direction of the vehicles 6*a* to 6*c* is straight to a traffic signal 2 side, and the approach direction of the vehicles 7*a* to 7*c* is to a traffic signal 2 side after turning to the left.

The vehicle ID may be recorded to the ROM of the construction detector 13 in advance. Further, information regarding the speed of the vehicle, the approach direction of the vehicle to the construction section 1, a distance from the vehicle along the road to the construction section 1, and the position (i.e., the latitude, the longitude) of the vehicle is acquired by sending a request to the navigation apparatus 12.

The navigation apparatus 12 determines a shortest route to the construction section 1 based on the map data and the present location/travel direction of the vehicle when distance information along the road to the construction section 1 is requested. After determining the route, the navigation apparatus 12 further determines a distance from the vehicle to the construction section 1 along the determined route, and transmits the determined distance as distance information to the construction detector 13.

Further, the navigation apparatus 12 determines the shortest route to the construction section 1 based on the map data and the present location/travel direction of the vehicle when the approach direction to the construction section 1 is requested. After determining the route, the navigation apparatus 12 further determines whether the vehicle goes straight, or turns to the left/right in the travel along the route before reaching the construction section 1, and transmits the determined travel direction as approach direction information to the construction detector 13.

The construction detector 13 may be configured not to generate and transmit the vehicle data if the travel direction of the vehicle is pointing away from the construction section 1.

As described above, the information including the vehicle ID, the current time, the vehicle speed, the approach direction, the distance to the construction section 1, the stopping time and the like is transmitted one after another from the vehicle(s) to the traffic signal control apparatus 4 as the vehicle(s) approaches the construction section 1.

Figure 5:
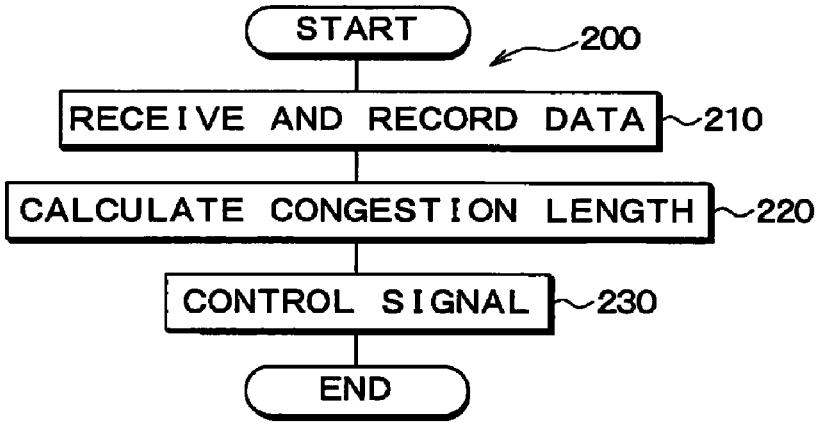
FIG. 5 is a flow chart of a process that is performed in a control unit of the traffic signal control apparatus.

The operation of the controller 43 of the traffic signal control apparatus 4 is now described. The traffic signal control apparatus 4 receives the vehicle data from one or more vehicles as described above. The controller 43 repeatedly executes a program 200 as shown in FIG. 5, and, in each cycle of program execution, the controller 43 receives and records the vehicle data which has been transmitted as mentioned above from the vehicle in S210 to the memory 42.

Then, in S220, the congestion length due to the construction section 1 and other data is calculated based on the vehicle data in the memory 42 recorded in the current cycle and recorded in the past. Then, in S230, the display contents of the traffic signals 2, 3 are controlled based on the calculated congestion length and the like.

More specifically, in S220, information about the congestion length, the direction of the congestion, the change in the degree of congestion and required time for the vehicle to pass the construction section 1 and the like (respectively corresponding to an example of the congestion condition) is calculated.

The calculation method for calculating the congestion length and the direction of the congestion is explained first. The controller 43 determines whether a traffic congestion (i.e., an example of the congestion condition) exists at multiple positions in the road around the construction section 1. More specifically, from among the vehicle data stored in the memory 42, the data having the time information that indicates time within a preset range (e.g., one minute) from the current time is extracted, and each of the extracted vehicle data is examined whether the data indicates a traffic congestion at the present location in each of the vehicle data.

The criterion for determining that the present location in the vehicle data is congested or not is that (a) speed limit of the road that includes the present location is read from the map data, (b) the speed limit is compared with the travel speed of the vehicle in the vehicle data, and (c) the present location is determined as congested if the travel speed of the vehicle is smaller than the speed limit by a preset value or more (e.g., if the travel speed is slower than the speed limit by half the value of the speed limit).

As a result of the determination of whether there is a traffic congestion, the congestion length is calculated based on an assumption that the section from the position that is determine to be congested to the construction section 1 is all congested. For example, if the travel speeds of the vehicles in the vehicle information from the vehicles 7*a* to 7*c* are lower than the speed limit of that position by or more than the preset value exclusively, the section between the vehicle 7*c* and the traffic signal 2 side of the construction section 1 is determined as being congested, thereby yielding the congestion length of L1+L3. Further, by determining the road that has the position of the congestion, the direction of the congestion is determined to be the left turn direction to the traffic signal 2.

In this manner, a speed of the traffic flow on each of the roads that approach the construction section 1 can be recognized, thereby enabling the determination that whether those roads started to have a congestion or not based on the comparison of the recognized traffic flow speeds with the speed limits of those sections. Further, the reliability of the calculated congestion condition can be increased by utilizing the vehicle data received from multiple vehicles.

Furthermore, the above-mentioned speed limit may be replaced with a constant speed such as 40 kilometers per hour or the like, regardless of the road. In addition, the congestion length from the position of the congestion to the construction section 1 may be calculated by utilizing the information indicative of the distance toward the construction section 1 that is derived from the vehicle data together with the position of the congestion, or may be calculated based on both of the position of the congestion and the map data.

Next, the calculation method for calculating the change in the degree of congestion is described. The controller 43 classifies the vehicle data in the memory 42 into categories according to the approach directions to the construction section 1, and either determines that the degree of congestion is currently decreasing in a certain approach direction if the stopping time of the vehicle in the vehicle data from that approach direction is decreasing, or determines that the degree of congestion in the certain approach direction is currently increasing if the stopping time is increasing in the vehicle data from that approach direction.

Next, the method for calculating the time required to pass the construction section 1 is described. The controller 43 extracts vehicle data that bears the same vehicle ID from the memory 42, and determines an actual travel time for the vehicle to pass the construction section 1 based on the time information and the position information in the extracted vehicle-data. The actual travel time is calculated for multiple vehicles, and the statistically representative value such as the average of the calculation results, or the latest value of the calculation is used as the required time for the vehicle to pass the construction section 1.

Next, the-details of the control of the signals 2, 3 in S230 are described. For example, the congestion length on the traffic signal 2 side and the congestion length from the traffic signal 3 side are compared, and the time for displaying the traffic allowance signal is increased on the longer congestion side, with the decrease of the time for displaying the traffic allowance signal on the other side (i.e., the shorter congestion side), based the congestion length and the information of the congestion direction calculated in S220. In that case, as shown in FIG. 2, if there are multiple directions for approaching the construction section 1 from the traffic signal 2 side, that is, more practically, the traffic approaches the construction section 1 from a straight direction and from a left turn direction, the congestion length on the traffic signal 2 side is calculated as a total of the two congestion lengths without adding the duplicated portions of congestion from two directions.

Figure 6:
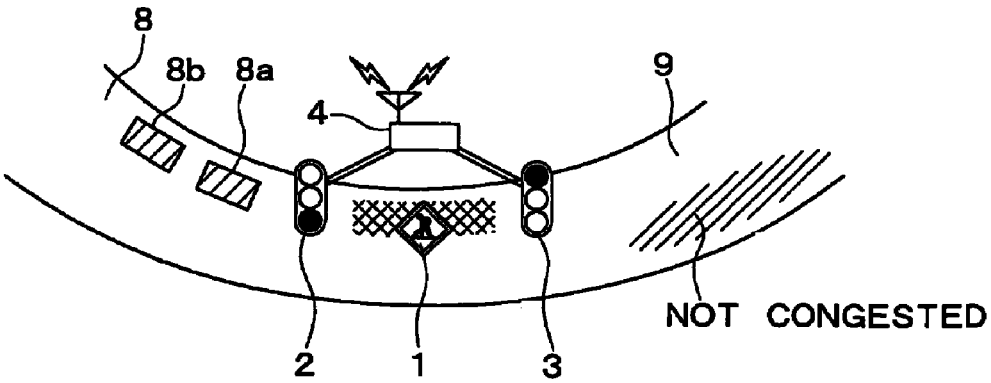
FIG. 6 is another illustration of the traffic congestion easing system in the embodiment of the present disclosure.

According to the above calculation scheme, if the congestion does not exist on the traffic signal 3 side in a lane 9 as shown in FIG. 6, the time of displaying the traffic allowance signal on the traffic signal 2 side increases, and the waiting time of vehicles 8*a*, 8*b* in a lane 8 on the traffic signal 2 side is decreased. That is, if there is no traffic from the traffic signal 3 side, the traffic from the signal 2 side should have less waiting time. The above signal control scheme of the present embodiment accords with that situation.

Further, if the information regarding the change in the degree of congestion is utilized, the increase amounts of the degree of congestion on both sides (i.e., the traffic signal 2 side and the traffic signal 3 side) may be compared for increasing the time of displaying the traffic allowance signal on a side that has a larger increase amount and for decreasing the time of displaying the traffic allowance signal on the other side. In that case, if there are more than one direction that approach the construction section 1 from the traffic signal 2 side as shown in FIG. 2, the increase amount of the degree of congestion from that direction may be calculated as a total of the increase amounts from those multiple directions.

In addition, the control of the display contents of the traffic signals 2, 3 (e.g., the time of the display of the traffic allowance signal) may be based on the combination of the information on the congestion length, the direction of congestion, and the change in the degree of congestion.

Furthermore, in addition to the above control, the road environment around the construction section 1 may be taken into consideration for controlling the display contents of the signals 2, 3. For example, the existence of the priority road, the existence of other traffic signal beside the traffic signals 2, 3, the existence of the bridge pier, the existence of the railroad crossing, whether there is a school district or not, the existence of the high-accident locations may be considered. The information on that kind of consideration is read from the map data in the memory 42.

More practically, for example, if a priority road (e.g., a major road) is included in the approach direction on the traffic signal 2 side of the construction section 1, the traffic allowance signal may have a longer display time in comparison to the case that there is no major road on the traffic signal 2 side. This kind of adjustments may be reasonable because the traffic of the major road is expected to be heavier than the other roads.

Further, if there are the bridge pier, the railway crossing, the other signals besides the traffic signals 2, 3 in the proximity (e.g., within 500 meters) of the construction section 1 in the road that approaches the construction section 1 from the traffic signal 2 side, the traffic allowance signal of the signal 2 may have the longer display time in comparison to the case otherwise. This kind of adjustments may be reasonable because the existence of the other traffic signal, the pier, the railway crossing in the proximity of the construction section 1 indicates that a higher possibility of vehicles entering a specific side of the construction section 1 from multiple directions, leading to the increase of the congestion length on that specific side of the construction section 1.

Further, if there are the bridge pier, the railway crossing, the other signals besides the traffic signals 2, 3 in the proximity (e.g., within 500 meters) of the construction section 1, the traffic allowance signal of the signal 2 may have the longer display time in comparison to the case otherwise. This kind of adjustments may be reasonable because the existence of the other traffic signal, the pier, the railway crossing in the proximity of the construction section 1 indicates that a higher possibility of vehicles entering a specific side of the construction section 1 from multiple directions, leading to the increase of the congestion length on that specific side of the construction section 1.

Further, if there are the school district, the high accident locations in the proximity (e.g., within 500 meters) of the construction section 1, the traffic allowance signal of the signal 2 may have the shorter display time, so that the number of vehicles entering the construction section 1 is decreased.

Furthermore, the congestion condition determined in S220 not utilized for the control of the traffic signals 2, 3 may be recorded in the memory 42. The data in the memory may be utilized for the congestion analysis due to the construction work later.

As has been described in the above description, the traffic signal control apparatus 4 acquires the position information and the travel condition information from the vehicles around the construction section 1 through wireless communication (S210), determines the congestion condition at the position indicated by the position information based on the travel condition information (S220), and controls the display contents of the traffic signals 2, 3 for easing the congestion around the construction section 1 based on the determination results (S230).

In this manner, the traffic signal control apparatus 4 can acquire the travel condition information at the vehicle positions by receiving the position information and the travel condition information of the vehicles, thereby being enabled to determine the positions of the received travel condition of the vehicles based on the position information transmitted together with the travel condition information such as the longitude, the latitude, the distance toward the construction section along the road. Therefore, the vehicle information can be acquired from various positions, and the congestion condition can be determined more accurately according to the variety of the available positions in comparison to the conventional technique.

Further, because the traffic signal control apparatus 4 controls the display contents of the traffic signals 2, 3 for easing the congestion around the construction section based on the determination results of the congestion condition, the apparatus 4 positively contributes to the ease of the congestion due to the construction work, not just the detection of the congestion condition.

Further, the traffic signal control apparatus 4 acquires the travel speed information of the vehicle as the information on the travel condition, determines the existence or non-existence of the congestion at the position indicated in the acquired position information based on the acquired travel speed information, and calculates the congestion length which is caused by the construction section 1 based on the determination results.

According to the above determination scheme, the traffic signal control apparatus 4 can determine the existence or non-existence of the congestion based on the speed of the vehicle in various position, thereby being enabled to calculate how far the congestion is extending Further, the traffic signal control apparatus 4 acquires information on the stopping time of the vehicle as the information on the travel condition, and, based on the acquired stopping time, the apparatus 4 controls the display contents of the traffic signals 2, 3. In this manner, the traffic signal control apparatus 4 can determine the congestion condition according to the stopping time of the vehicle at the various positions.

Further, the traffic signal control apparatus 4 controls the display contents of the traffic signals 2, 3 based on the road environment around the construction section 1. Therefore, the control by the traffic signal apparatus 4 can be more suitably adjusted to the road environment around the construction section.

Other Embodiments

Although the present disclosure has been fully described in connection with preferred embodiment thereof with reference to the accompanying drawings, it is to be noted that various changes and modifications will become apparent to those skilled in the art.

For example, in the above embodiments, the construction detector 13 determines the position of the traffic signal control apparatus 4 based on the position information transmitted from the traffic signal control apparatus 4. However, the construction detector 13 may receive the position information of the traffic signal control apparatus 4 from a wireless communication apparatus that is different from the traffic signal control apparatus 4 through wireless communication such as VICS (i.e., a traffic information system implemented in Japan) or the like.

Further, the navigation apparatus 12 may serve as the construction detector 13.

Further, the traffic signal control apparatus 4 may determine a distance along the road from the vehicle to the construction section 1 based on the position of the vehicle transmitted from the vehicle and the map data in the memory 42. In that case, the construction detector 13 needs not transmit the information on the distance along the road from the vehicle to the traffic signal control apparatus 4.

Further, each of the functions realized by the execution of a program in the controller 43 in above-mentioned embodiments may alternatively be realized by using hardware such as FPGA having programmable circuit configuration.

Such changes, modifications, and summarized scheme are to be understood as being within the scope of the present disclosure as defined by appended claims.

What is claimed is:

1. A traffic congestion easing system including a traffic signal control apparatus that controls traffic signals disposed on both ends of a construction section and a construction detector disposed in a vehicle, comprising:

a traffic signal control apparatus having:

a communicator configured to transmit position information of a construction section to a vehicle in a proximity of the construction section;

a vehicle information acquisition unit for acquiring, from the vehicle in the proximity of the construction section, information regarding a vehicle position and a travel condition of the vehicle through wireless communication;

a determination unit for determining a congestion condition at the position indicated in the information regarding the vehicle position that is acquired by the vehicle information acquisition unit based on the information regarding the travel condition of the vehicle that is acquired by the vehicle information acquisition unit; and a control unit for controlling a signaling condition of the traffic signals based on a determination result of the determination unit so as to ease a traffic congestion around the construction section, wherein the travel condition of the vehicle acquired by the vehicle information acquisition unit includes approach direction information indicating whether the vehicle approaches straight to the construction section or by turning towards the construction section, the determination unit determines the congestion condition around the construction section based on the approach direction information, the construction detector generates the approach direction information based on the position information transmitted from the signal control apparatus, and transmits, to the vehicle, information including the generated approach direction information as well as the information regarding,the vehicle position and travel condition of the vehicle.

2. The traffic congestion easing system of claim 1, wherein the vehicle information acquisition unit acquires vehicle speed information as the information regarding the travel condition of the vehicle, and the determination unit determines whether or not the traffic congestion at a position that is indicated in the information regarding the vehicle position based on the vehicle speed information.

3. The traffic congestion easing system of claim 1, wherein the vehicle information acquisition unit acquires a stop time of the vehicle as the information regarding the travel condition of the vehicle.

4. The traffic congestion easing system of claim 1, wherein the control unit takes a road environment around the construction section into consideration for controlling the signaling condition of the traffic signals.

5. The traffic congestion easing system of claim 1, wherein the determination unit further determines whether or not the congestion condition around the construction section is congested in a particular direction based on the information from each of the vehicles in the proximity of the construction section received through wireless communication.

6. The traffic congestion easing system of claim 1, wherein the determination unit (i) includes, as adding to the congestion condition:

vehicles having approach direction information indicating that the vehicles are turning from a same side of a traffic signal toward the construction section, vehicles having approach direction information indicating that the vehicles are approaching straight through the traffic signal toward the construction section, and (ii) excludes, as not adding to the congestion condition:

vehicles having approach direction information indicating that the vehicles are turning from the same side of the traffic signal away from the construction section.

7. A non-transitory computer-readable storage medium storing a program product having computer-executable instructions, when executing causing a computer to perform steps of a method for easing traffic congestion in a system including a traffic signal control apparatus that controls traffic signals disposed on both ends of a construction section and a construction detector disposed in a vehicle, the method comprising:

transmitting position information of a construction section to a vehicle in a proximity of the construction section;

providing a vehicle information acquisition unit for acquiring, from the vehicle in the proximity of the construction section, information regarding a vehicle position and a travel condition of the vehicle through wireless communication;

providing a determination unit for determining a congestion condition at the position indicated in the information regarding the vehicle position that is acquired by the vehicle information acquisition unit based on the information regarding the travel condition of the vehicle that is acquired by the vehicle information acquisition unit; and providing a control unit for controlling a signaling condition of the traffic signals based on a determination result of the determination unit so as to ease a traffic congestion around the construction section, wherein the travel condition of the vehicle acquired by the vehicle information acquisition unit includes approach direction information indicating whether the vehicle approaches straight to the construction section or by turning towards the construction section, the determination unit determines the congestion condition around the construction section based on the approach direction information, the construction detector generates the approach direction information based on the position information transmitted from the signal control apparatus, and transmits, to the vehicle, information including the generated approach direction information as well as the information regarding the vehicle position and travel condition of the vehicle.

8. The non-transitory computer-readable storage medium of claim 7, wherein the determination unit further determines whether or not the congestion condition around the construction section is congested in a particular direction based on the information from each of the vehicles in the proximity of the construction section received through wireless communication.

9. The non-transitory computer-readable storage medium of claim 8, wherein the determination unit (i) includes, as adding to the congestion condition:

vehicles having approach direction information indicating that the vehicles are turning from a same side of a traffic signal toward the construction section, vehicles having approach direction information indicating that the vehicles are approaching straight through the traffic signal toward the construction section, and (ii) excludes, as not adding to the congestion condition:

vehicles having approach direction information indicating that the vehicles are turning from the same side of the traffic signal away from the construction section.

* * * * *